US007918202B2

(12) United States Patent
Kwak et al.

(10) Patent No.: US 7,918,202 B2
(45) Date of Patent: Apr. 5, 2011

(54) VARIABLE VALVE LIFT APPARATUS

(75) Inventors: Young Hong Kwak, Suwon (KR); Kiyoung Kwon, Seoul (KR); Ki Uk Shin, Hwaseong (KR); Jin Kook Kong, Suwon (KR); Kyoung Joon Chang, Seongnam (KR)

(73) Assignee: Hyundai Motor Company, Seoul (KR)

( * ) Notice: Subject to any disclaimer, the term of this patent is extended or adjusted under 35 U.S.C. 154(b) by 367 days.

(21) Appl. No.: 12/243,166

(22) Filed: Oct. 1, 2008

(65) Prior Publication Data

US 2009/0151677 A1 Jun. 18, 2009

(30) Foreign Application Priority Data

Dec. 14, 2007 (KR) ..... 10-2007-0131566

(51) Int. Cl.
*F01L 1/14* (2006.01)

(52) U.S. Cl. ..... 123/90.48; 123/90.44; 123/90.52; 123/90.55; 74/569

(58) Field of Classification Search ..... 123/90.16, 123/90.44, 90.48, 90.52, 90.55, 90.6; 74/567, 74/569

See application file for complete search history.

(56) References Cited

U.S. PATENT DOCUMENTS 7,484,488 B2 * 2/2009 Cecur et al. ..... 123/90.48

FOREIGN PATENT DOCUMENTS

JP 10-047029 A 2/1998
JP 2003-027908 A 1/2003

* cited by examiner

*Primary Examiner* — Ching Chang
(74) *Attorney, Agent, or Firm* — Morgan, Lewis & Bockius LLP

(57) ABSTRACT

A variable valve apparatus includes a high lift cam and a low lift cam in parallel with the high lift cam. A tappet body includes a high lift tappet body that constantly contacts the high lift cam, and a low lift tappet body that is disposed in the high lift tappet body and selectively contacts the low lift cam. An inner column is connected with a valve and reciprocally disposed within the low lift tappet body. A supporting member is disposed below the tappet body. A lost motion elastic member is disposed between the supporting member and the tappet body for supplying restoring force to the tappet body. A first connector selectively connects the high lift tappet body and the low lift tappet body. A second connector selectively connects the low lift tappet body and the inner column.

5 Claims, 6 Drawing Sheets

(a)

(b)

(c)

(a)

(b)

(c)

VARIABLE VALVE LIFT APPARATUS

CROSS-REFERENCE TO RELATED APPLICATION

This application claims priority to, and the benefit of, Korean Patent Application No. 10-2007-0131566, filed in the Korean Intellectual Property Office on Dec. 14, 2007, the entire contents of which are incorporated herein by reference.

BACKGROUND OF THE INVENTION (a) Field of the Invention

The present invention relates to a variable valve apparatus.

(b) Description of the Related Art

A typical combustion chamber of an automotive engine is provided with an intake valve, for supplying an air/fuel mixture, and an exhaust valve, for expelling burned gas. The intake and exhaust valves are opened and closed by a valve lift apparatus connected to a crankshaft.

A conventional valve lift apparatus has a fixed valve lift amount due to a fixed cam shape. Therefore, it is impossible to adjust the amount of gas that is introduced or exhausted. However, valve timing and amount of lift should ideally be optimized for different driving speeds.

The above information disclosed in this Background section is only for enhancement of understanding of the background of the invention and therefore it may contain information that does not form the prior art that is already known in this country to a person of ordinary skill in the art.

SUMMARY OF THE INVENTION

A variable valve apparatus includes a high lift cam and a low lift cam in parallel with the high lift cam. A tappet body includes a high lift tappet body that constantly contacts the high lift cam, and a low lift tappet body that is disposed in the high lift tappet body and selectively contacts the low lift cam. An inner column is connected with a valve and reciprocally disposed within the low lift tappet body. A supporting member is disposed below the tappet body. A lost motion elastic member is disposed between the supporting member and the tappet body for supplying restoring force to the tappet body. A first connector selectively connects the high lift tappet body and the low lift tappet body. A second connector selectively connects the low lift tappet body and the inner column.

The first connector may include a connecting pin selectively connecting the high lift tappet body and the low lift tappet body, and an elastic member supplying restoring force to the connecting pin. Hydraulic pressure may be selectively supplied to the connecting pin.

The second connector may include a connecting pin selectively connecting the low lift tappet body and the inner column, and an elastic member supplying restoring force to the connecting pin. Hydraulic pressure may be selectively supplied to the connecting pin. The connecting pin may include a bar, and the inner column may include an insertion hole for the bar to be inserted therein.

The lost motion elastic member may include a first lost motion spring disposed between the high lift tappet body and the supporting member, and a second lost motion spring disposed between the low lift tappet body and the supporting member.

DETAILED DESCRIPTION OF PREFERRED EMBODIMENTS

Figure 1:
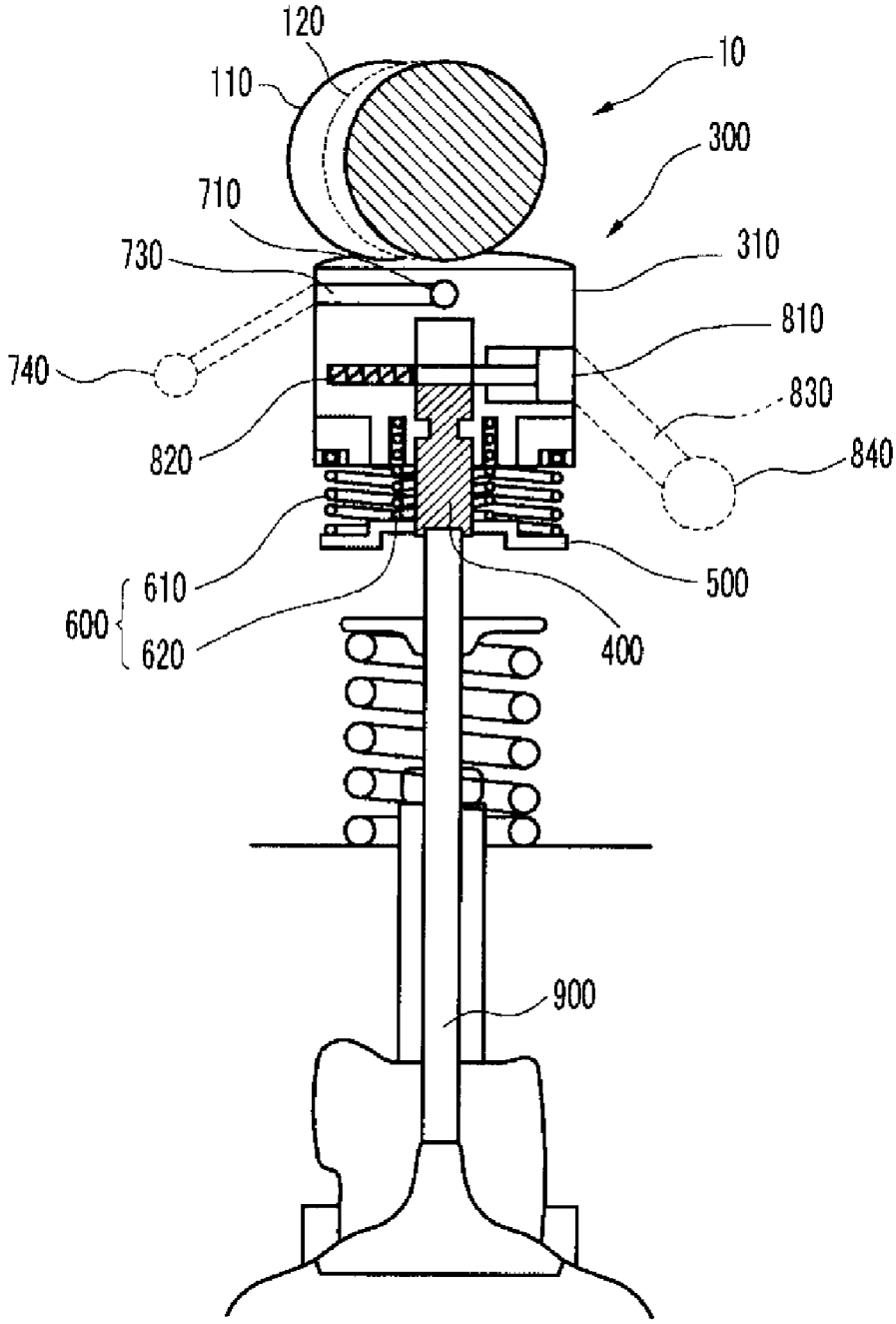
FIG. 1 is a side cross-sectional view of a variable valve lift apparatus according to an exemplary embodiment.

An exemplary embodiment of the present invention will hereinafter be described in detail with reference to the accompanying drawings.

Referring to FIG. 1, FIG. 2, FIG. 3, and FIG. 6, a variable valve lift apparatus 10 according to an exemplary embodiment of the present invention includes a high lift cam 110, a low lift cam 120 in parallel with the high lift cam 110, and a tappet body 300. The tappet body 300 includes a high lift tappet body 310 that constantly contacts the high lift cam 110, and a low lift tappet body 320 that is disposed in the high lift tappet body 310 and selectively contacts the low lift cam 120.

The apparatus 10 further includes an inner column 400 connected with a valve 900 and reciprocally disposed within the low lift tappet body 320, a supporting member 500 disposed below the tappet body 300, and a lost motion elastic member 600 disposed between the supporting member 500 and the tappet body 300 for supplying restoring force to the tappet body 300.

The apparatus 10 further includes a first connector (described below) selectively connecting the high lift tappet body 310 and the low lift tappet body 320, and a second connector (described below) selectively connecting the low lift tappet body 320 and the inner column 400.

Figure 6:
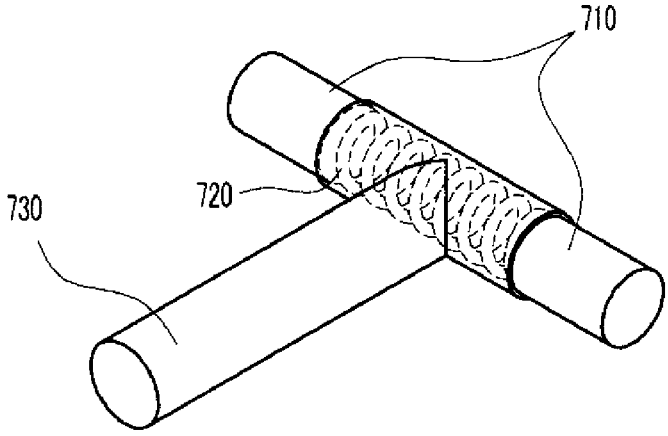
FIG. 6(*a*) to (*c*) are perspective view of a first connector, a second connecting pin, and an inner column of a variable valve lift apparatus, respectively, according to an exemplary embodiment.
Figure 6:
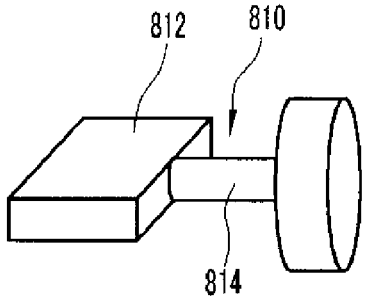
Figure 6:
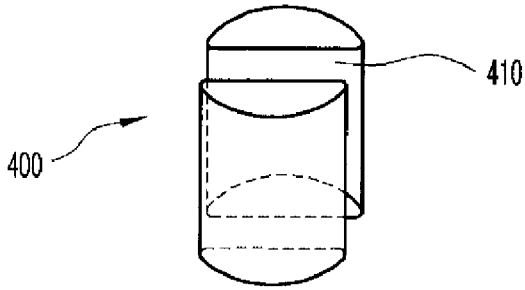

Referring to FIG. 1 and FIG. 6(*a*), the first connector includes a first connecting pin 710 selectively connecting the high lift tappet body 310 and the low lift tappet body 320, a first elastic member 720 supplying restoring force to the first connecting pin 710, and a first hydraulic line 730 supplying hydraulic pressure to the first connecting pin 710.

Referring to FIG. 1 and FIG. 6(*b*), the second connector includes a second connecting pin 810 selectively connecting the low lift tappet body 320 and the inner column 400, a second elastic member 820 supplying restoring force to the second connecting pin 810, and a second hydraulic line 830 supplying hydraulic pressure to the second connecting pin 810.

The second connecting pin 810 includes a plate 812 and a bar 814, and as shown in FIG. 6(*c*), the inner column 400 has an insertion hole 410 therein, in which the bar 814 is selectively disposed, which will be described below.

Figure 2:
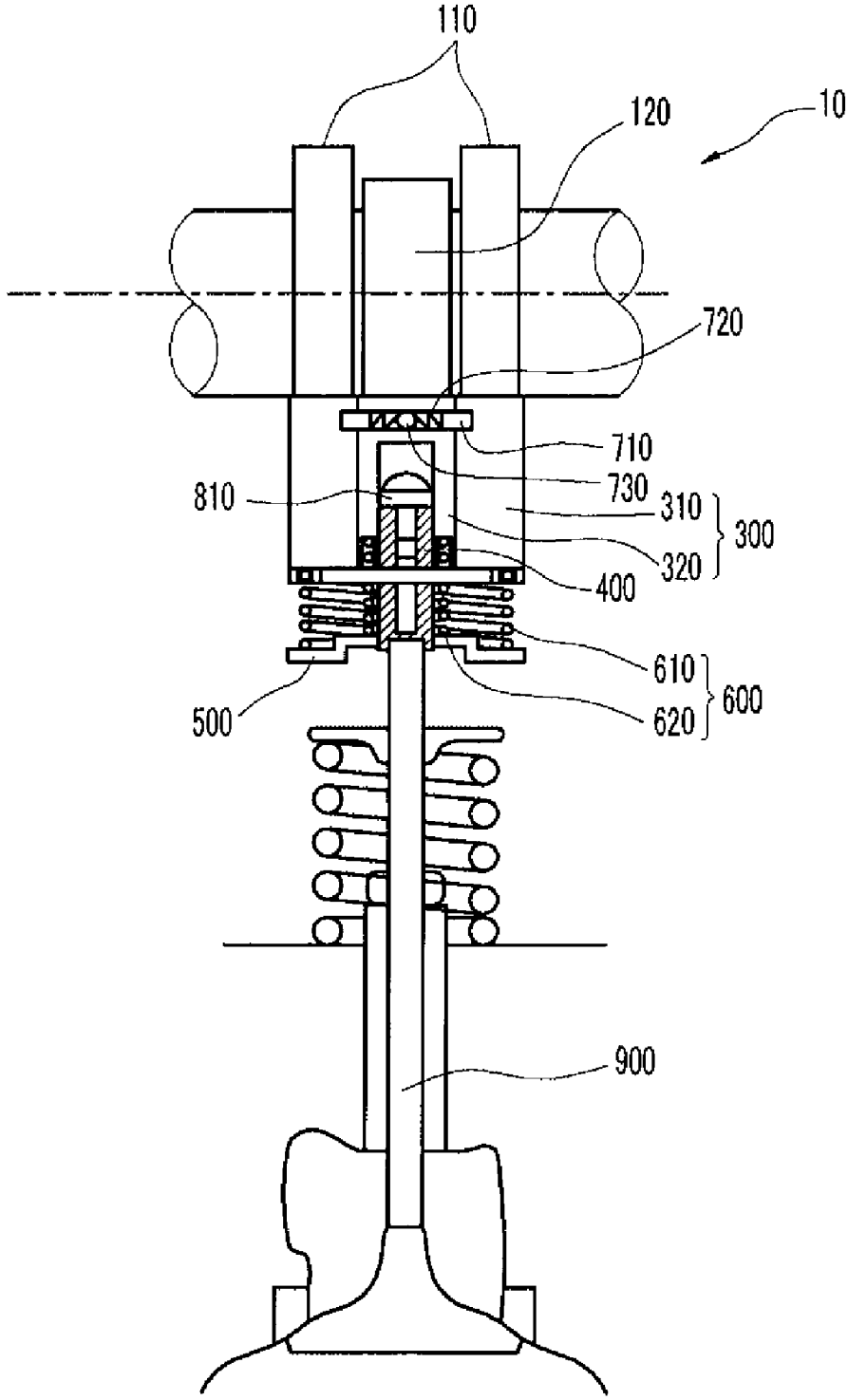
FIG. 2 and FIG. 3 are front cross-sectional views of a variable valve lift apparatus according to an exemplary embodiment in high lift mode.

Referring to FIG. 1 and FIG. 2, the lost motion elastic member 600 includes a first lost motion spring 610 disposed between the high lift tappet body 310 and the supporting member 500, and a second lost motion spring 620 disposed between the low lift tappet body 320 and the supporting member 500.

Hereinafter, referring to FIG. 1 to FIG. 5, operation of the variable valve lift apparatus according to an exemplary embodiment will be explained.

Figure 3:
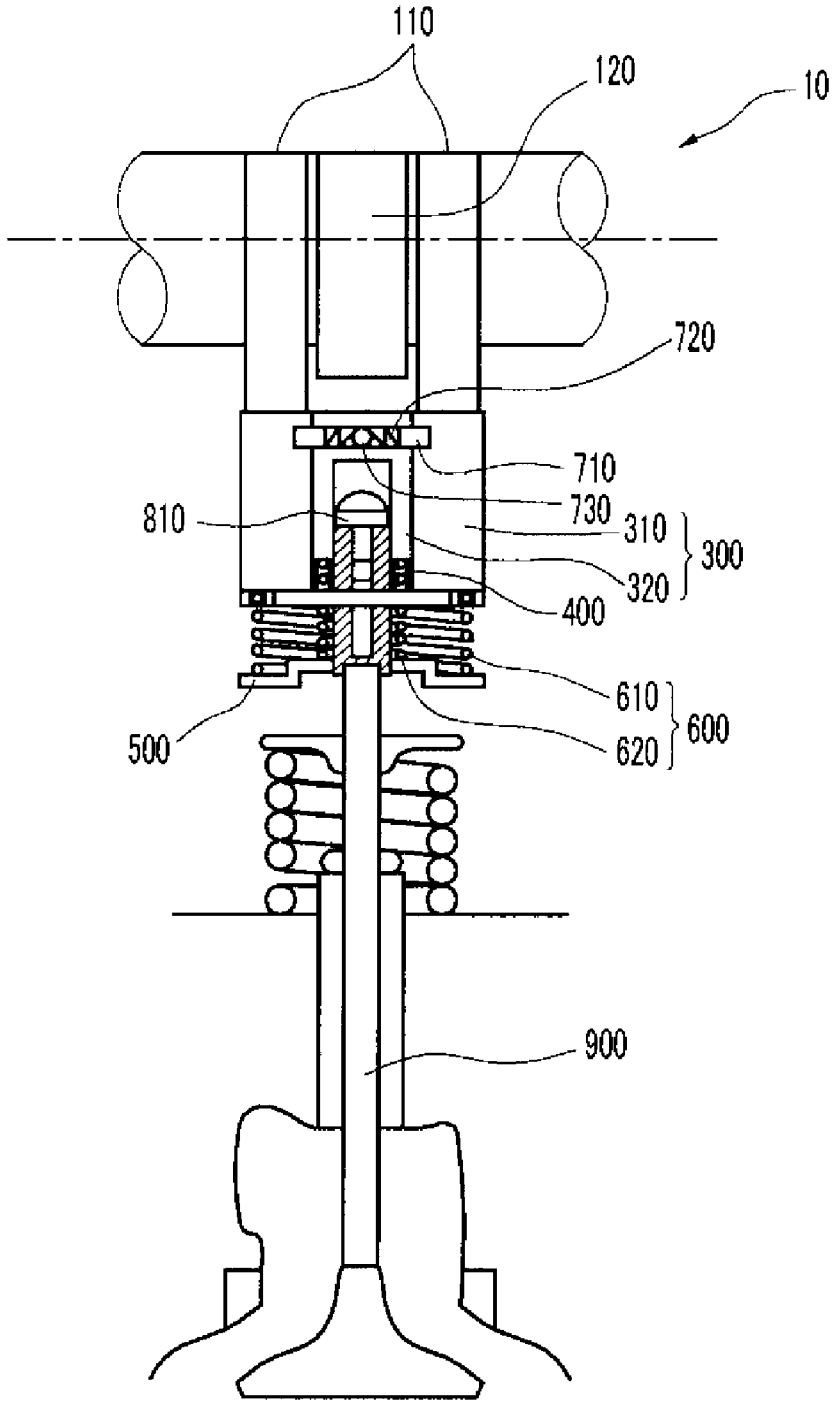

In high lift mode, as shown in FIG. 1 to FIG. 3, a first hydraulic pressure supplying apparatus 740 supplies hydraulic pressure to the first connecting pin 710. The first connecting pin 710 connects the high lift tappet body 310 with the low lift tappet body 320, so the tapped bodies 310, 320 reciprocate integrally. The high lift cam 110 opens and closes the valve through the high lift tappet body 310.

Figure 4:
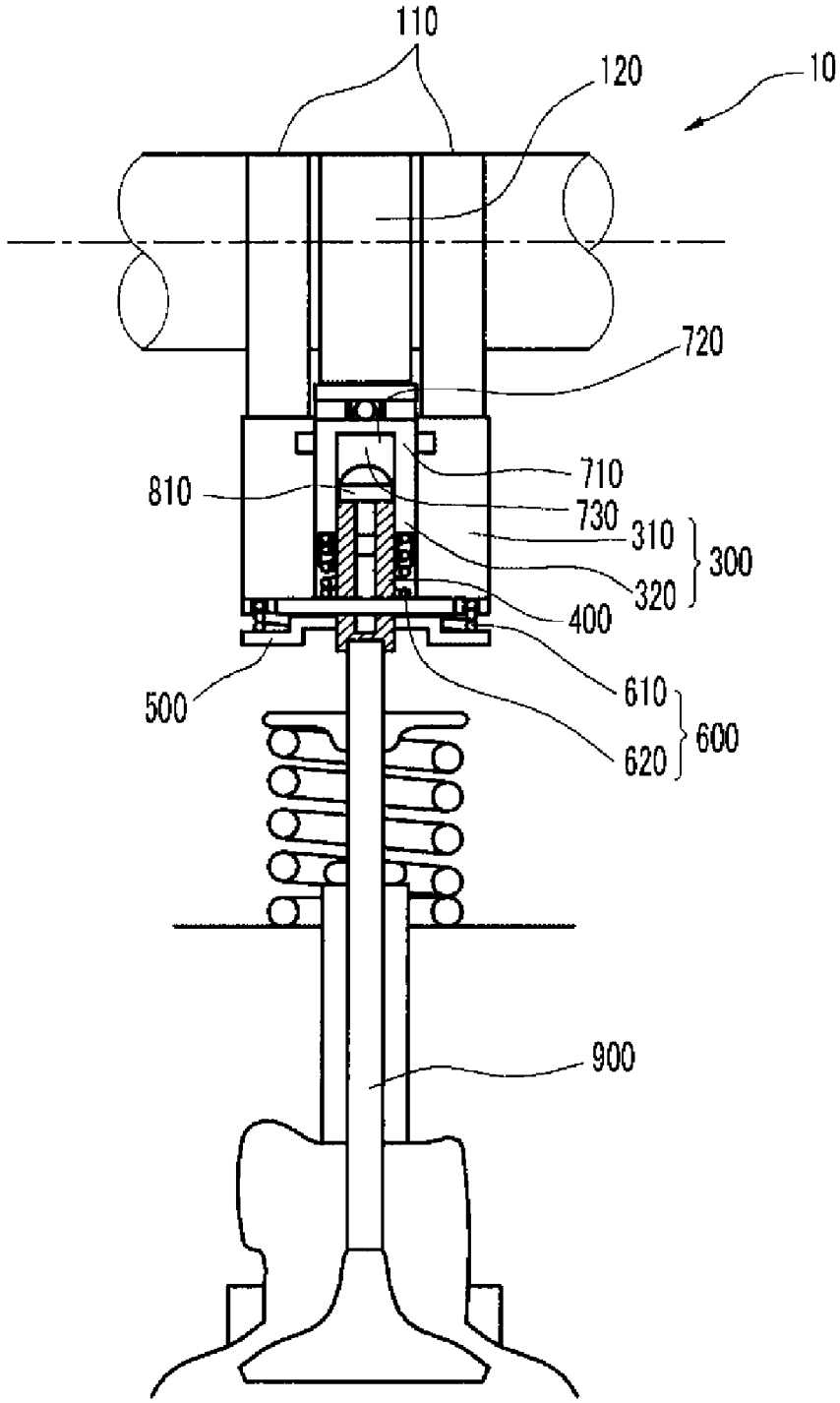
FIG. 4 is a front cross-sectional view of a variable valve lift apparatus according to an exemplary embodiment in low lift mode.

In low lift mode, as shown in FIG. 1 and FIG. 4, the hydraulic pressure is released from the first connecting pin 710. The first connecting pin 710 is disconnected from the high lift tappet body 310 by restoring force of the first elastic member 720, and the high lift tappet body 310 and the low lift tappet body 320 are separated from each other. The high lift tappet body 310 has lost motion, and the low lift cam 120 opens and closes the valve 900 though the low lift tappet body 320.

Figure 5:
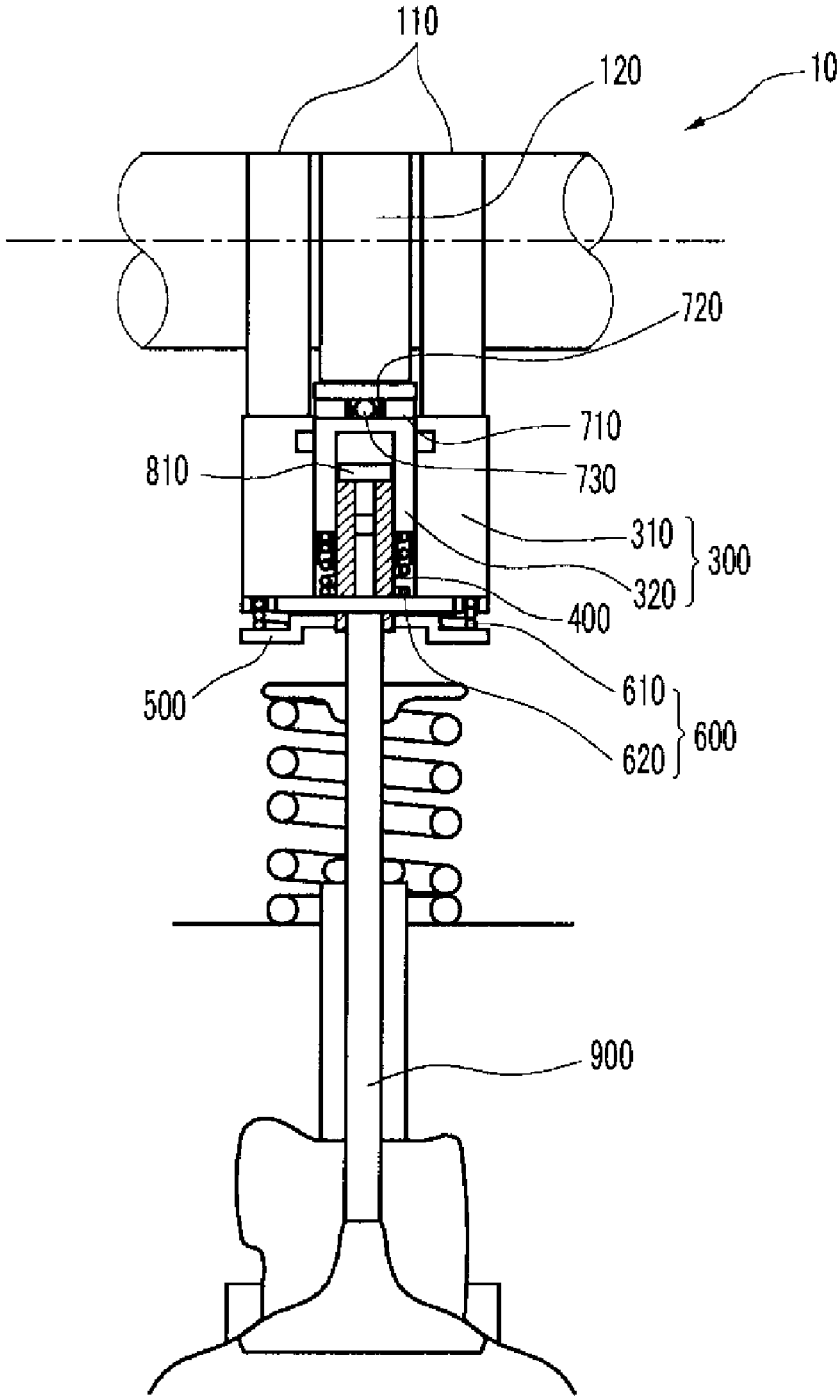
FIG. 5 is a front cross-sectional view of a variable valve lift apparatus according to an exemplary embodiment in CDA mode.

In CDA mode, as shown FIG. 1 and FIG. 5, a second hydraulic pressure supplying apparatus 840 supplies hydraulic pressure to the second connecting pin 810. The bar 814 is inserted into the insertion hole 410 of the inner column 400, and the tappet body 300 has lost motion so that the valve 900 is not opened.

The appropriate mode (i.e. high lift, low lift, or CDA) is selected according to engine operation by an engine control unit (ECU) and associated sensors in a manner that can be designed and implemented by a person of ordinary skill in the art based on the teachings herein.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A variable valve apparatus comprising:

a high lift cam;

a low lift cam in parallel with the high lift cam;

a tappet body comprising a high lift tappet body that constantly contacts the high lift cam, and a low lift tappet body that is disposed in the high lift tappet body and selectively contacts the low lift cam;

an inner column connected with a valve and reciprocally disposed within the low lift tappet body;

a supporting member disposed below the tappet body;

a lost motion elastic member disposed between the supporting member and the tappet body for supplying restoring force to the tappet body;

a first connector selectively connecting the high lift tappet body and the low lift tappet body; and a second connector selectively connecting the low lift tappet body and the inner column.

2. The variable valve apparatus of claim 1, wherein the first connector comprises:

a connecting pin selectively connecting the high lift tappet body and the low lift tappet body; and an elastic member supplying restoring force to the connecting pin;

wherein hydraulic pressure is selectively supplied to the connecting pin.

3. The variable valve apparatus of claim 1, wherein the second connector comprises:

a connecting pin selectively connecting the low lift tappet body and the inner column; and an elastic member supplying restoring force to the connecting pin;

wherein hydraulic pressure is selectively supplied to the connecting pin.

4. The variable valve apparatus of claim 3, wherein the connecting pin comprises a bar, and wherein the inner column comprises an insertion hole configured and dimensioned for the bar to be inserted therein.

5. The variable valve apparatus of claim 1, wherein the lost motion elastic member comprises:

a first lost motion spring disposed between the high lift tappet body and the supporting member; and a second lost motion spring disposed between the low lift tappet body and the supporting member.

* * * * *